US006955753B1

(12) United States Patent
Gomez

(10) Patent No.: US 6,955,753 B1
(45) Date of Patent: Oct. 18, 2005

(54) TREATMENT OF CRUDE OILS

(75) Inventor: Rodolfo Antonio M. Gomez, Urrbrae (AU)

(73) Assignee: RMG Services Pty.Ltd., Adelaide (AU)

( * ) Notice: Subject to any disclaimer, the term of this patent is extended or adjusted under 35 U.S.C. 154(b) by 532 days.

(21) Appl. No.: 10/130,205

(22) PCT Filed: Nov. 13, 2000

(86) PCT No.: PCT/AU00/01390

§ 371 (c)(1),
(2), (4) Date: May 15, 2002

(87) PCT Pub. No.: WO01/36564

PCT Pub. Date: May 25, 2001

(30) Foreign Application Priority Data

| | | |
|---|---|---|
| Nov. 16, 1999 | (AU) | PQ4065 |
| Nov. 18, 1999 | (AU) | PQ4109 |
| Nov. 19, 1999 | (AU) | PQ4122 |
| Nov. 22, 1999 | (AU) | PQ4147 |
| Jan. 27, 2000 | (AU) | PQ5270 |
| Feb. 3, 2000 | (AU) | PQ5390 |
| Feb. 14, 2000 | (AU) | PQ5573 |
| Mar. 28, 2000 | (AU) | PQ6524 |

(51) Int. Cl.[7] ..... C10G 17/00; C10G 21/00; B01D 11/00

(52) U.S. Cl. ..... 208/252; 208/251 R; 208/208 R; 208/228; 208/230; 208/226; 208/211; 208/271; 204/157.15; 196/14.52

(58) Field of Search ..... 208/252, 251 R, 208/208 R, 228, 230, 226, 211, 271; 204/157.15; 196/14.52

(56) References Cited

U.S. PATENT DOCUMENTS

| | | | | | |
|---|---|---|---|---|---|
| 1,686,491 | A | * | 10/1928 | Hughes et al. | 208/263 |
| 1,785,242 | A | * | 12/1930 | Becker et al. | 208/263 |
| 2,157,315 | A | * | 5/1939 | Archibald | 208/252 |
| 3,095,368 | A | * | 6/1963 | Bieber et al. | 208/252 |
| 4,234,402 | A | | 11/1980 | Kirkbride | 204/162 |
| 4,279,722 | A | | 7/1981 | Kirkbride | 204/162 |
| 4,408,999 | A | | 10/1983 | Nadkarni et al. | |
| 4,539,096 | A | | 9/1985 | Rudnick | |
| 5,087,350 | A | | 2/1992 | Paris-Marcano | |
| 5,985,137 | A | | 11/1999 | Ohsol et al. | 208/263 |
| 6,068,737 | A | | 5/2000 | De Chamorro et al. | 204/157 |

* cited by examiner

*Primary Examiner*—Walter D. Griffin
(74) *Attorney, Agent, or Firm*—Crowell & Moring LLP

(57) ABSTRACT

A process and apparatus to extract and recover heavy metals and sulfur from crude oil or petroleum fuel products including the steps of emulsifying the crude oil with an emulsifying agent, adding a leach solution to the emulsified crude oil and leaching the emulsified crude oil at elevated temperature and pressure to give a leached emulsified crude oil. The leach solution may be acid or alkali. A proportion of the leach solution is extracted for recovering heavy metals. There can also be a microwave hydro-treating step using hydrogen gas at a temperature below 220° C. to ensure there is no quality degradation in the crude feed to produce a desulfurized crude oil and a hydrogen sulphide by-product and recovering sulfur from the hydrogen sulphide by-product.

67 Claims, 10 Drawing Sheets

TREATMENT OF CRUDE OILS

FIELD OF INVENTION

This invention relates to the treatment of crude oils or petroleum products to extract heavy metals and sulfur resulting in a crude oils or petroleum products which is readily refined in conventional oil refineries or resulting in the crude oils or petroleum products able to be used in industry and transportation without causing environmental damage.

PRIOR ART

Studies have been made about the distribution and possible structure of heavy metals in petroleum products such as "Mechanism of Occurrence of Metals in Petroleum Distillates" R. A. Woodle and W. B. Chandler, Jr, Industrial and Engineering Chemistry, v.44, No.11, Nov. 1952, p. 2591. More recently, Energy BioSystems Corporation of Woodlands, Tex., USA ("Recent Advances in Biodesulfurization of Diesel Fuel" 1999 Annual General Meeting, National Petrochemical and Refiners Association, Mar. 21–23, 1999, San Antonio, Tex., USA) have claimed success in removing sulfur from petroleum products by biodesulfurisation using a microbe. This process deals only with sulfur and the microbes have problems with removing some type of sulfur compounds such as 4,6 dimethyl dibenzothiopene; further, there is a by-product hydrocarbon compound which Energy BioSystems believe can be used as a surfactant base material. BioSystems suggest that their process would combine well with conventional hydro-desulfurisation in removing sulfur from petroleum products by pre-conditioning the petroleum product with their biodesulfurisation.

The conventional commercial method to remove sulfur usually from the residual of a distillation column is known as hydro-desulfurization. This is usually carried out at a high temperature of about 427 C with hydrogen gas applied to the charge. Catalyst such as cobalt and molybdenum on alumina are used to enhance the reaction.

Conventional hydro-desulfurization can not be applied to crude oil because the high temperature required will shift the TBP curve to the light end and produce low value gas and petroleum products. For similar reason, hydro-desulfurization of petroleum products such as automotive diesel would affect the desired quality of the petroleum product.

Kirkbride, C. G. was granted U.S. Pat. No. 4,234,402 (Nov. 18, 1980) for removing sulfur from coal and crude petroleum by applying microwaves to petroleum crude oils at room temperature but 1000 psig pressure of hydrogen. On a petroleum fraction obtained between the boiling point range of 400 to 500 degrees Fahrenheit containing 0.1% sulfur, Kirkbride obtained a sulfur removal of 86% by applying 1000 megacycles of microwave for 40 seconds. Applying microwaves under the same conditions but for 60 seconds on a crude sample containing 7% sulfur, Kirkbride was able to remove about 93% of the sulfur. Kirkbride preferred a batch system for his process which is a major disadvantage as continuous large capacity through-put processes are required by the oil industry. This is probably the main reason why Kirkbride's process was not adopted by the oil industry in spite of Kirkbride's subsequent U.S. Pat. No. 4,279,722 dealing with the use of microwaves in petroleum refining. Kirkbride's use of low temperature is a disadvantage as the applicants experimental observations indicate that microwaves are more efficient at higher temperatures. This is important where the crude oil sample contains sulfur compounds which are difficult to remove.

Nadkami et al were granted U.S. Pat. No. 4,408,999 (Oct. 11, 1983) concerning beneficiation of coal, oil shale, and similar carbonaceous solids to remove inorganic constituents by subjecting the carbonaceous solids with microwaves in the presence of an aqueous acid solution. Nadkami's process probably was not adopted to commercial practice because it is more economical to recover the sulfur from the flue gas and the heavy metals from the ashes after the coal is burnt in a boiler or furnace, in spite of corrosion problems in tubes and refractories.

There has not been a U.S. patents granted on this subject until May, 2000 probably because of the lack of development in large industrial size microwave generators and the means to introduce large quantities of the microwave into the commercial size reaction vessels.

U.S. Pat. No. 6,068,737 (May 30, 2000) was granted to De Chamorro, et al for the simultaneous removal of metals and sulfur from carbonaceous material using an acid medium and subjecting the mixture to microwave energy. This patent is very similar to Nadkami et al U.S. Pat. No. 4,408,999 on a process for removing sulfur and heavy metals contained in inorganic material from solid carbonaceous material. De Chamorro et al conducted their tests only on fine granules of coke and then claimed the process applicable to a wide range of carbonaceous material including bituminous sand and crude oil. This type of leaching of fine solid particles is similar to Applicant's U.S. Pat. No. 5,393,320 (Feb. 28, 1995) on the leaching of fine particles of nickel laterite ore with acid while the mixture is being irradiated with microwave energy. Chamorro et al did not describe the technique of efficiently contacting the crude oil and the acid leachate as this is very important for the successful leaching reactions between the acid medium, the sulfur and metallic compounds, and the microwaves. It must be appreciated that the claims of De Chamorro et al on crude oil are of a general nature and do not provide details of equipment or techniques which will make the process a practical reality. There were no details of the procedure for recovering the heavy metals and sulfur from the leach liquor. Further, without giving any basis, Chamorro et al state that their process applies only to crude oil with an API Index which exceeds 6 degrees. Applicant have in their laboratory a heavy crude with an API of 8 degrees. This material is so viscous that a quarter inch indentation at 18 C ambient takes about 1 hour to reform. An oil or bitumen of 6 degrees API would be more viscous and the leaching process described in general by De Camorro would not function in removing sulfur or heavy metals even at the temperature of the boiling point of the acid solution and 200 psig pressure specified by De Chamorro et al. To leach sulfur and heavy metals satisfactorily, the leach solution must be in contact with the sulfur and heavy metal molecules and the conventional heat or microwaves at the required time. This contact exposure requires intimate contact between the leach solution and the crude oil. The intimate contact requires a very large contact surface. This is achieved by breaking up the crude oil into very fine particles in the mixture of crude oil-leach solution.

Heavy crude oils which normally contain high sulfur and heavy metals are usually very viscous. Hence it will be seen that the first requirement of the process is to make this crude oil more fluid and broken-up into fine particles as the crude oil is mixed with the leaching solution to allow the greatest contact between the metallic compounds and sulfur compounds in the crude oil and the leaching solution. After leaching, the leached crude has to be separated from the leachate and the remaining small amount of leach solution need to be removed from the leached crude by washing to make the leached crude suitable for refining. This was not appreciated by De Chamorro et al as they reported only experimental results on leaching very fine granules of coke. In this invention, breaking up the crude oil is accomplished by applying commercially available solvents and emulsifiers, and the use of an apparatus which can break-up the crude oil into very fine particles and apply conventional heat and/or microwaves at the same time. After the leaching is accomplished, the leached crude oil and the loaded leach solution are separated.

The leaching step is preferably carried out at the lowest possible temperature to avoid degrading the quality of the crude oil. Laboratory tests also indicated that high pressure during leaching is desirable for efficient extraction. For some crude oils, conventional heating and acid electro-leaching may be sufficient. Some crude oils may be treated satisfactorily by conventional heating, acid electro-leaching and irradiation with microwave energy.

In this invention, if sufficient sulfur is not removed during acid leaching, the crude oil may be subsequently leached with an alkali such as caustic soda or soda ash with microwave energy, or hydro-desulfurized using microwave energy and hydrogen gas. The use of microwaves in removing sulfur from crude oil at comparatively lower temperature is supported by the concept that hydrocarbon molecules are more transparent to microwaves than organo-sulfur or organo-sulfur-metallic compounds. Microwave energy would activate the organo-sulfur and organo-sulfur-metallic compounds preferentially. The temperature of microwave hydro-treating is substantially less than conventional hydro-treating, minimising the effect on the quality of the crude oil.

Microwave generating equipment has advanced considerably in the past decades but industrial microwave equipment still has a high capital cost and higher unit energy cost than conventional heat. None of the U.S. patents disclosed above mention carrying out comparative tests using only conventional heat without microwaves. Applicant's extensive experience in the leaching of minerals indicate that some minerals are leached satisfactorily by conventional heating only but other minerals compounds are only leached satisfactorily using conventional heat and microwaves. Conventional heating must be considered as a first option to treat a crude oil to meet desired specifications if the treatment is to result in the lowest capital and operating cost.

The prior art shows the principles of leaching, electromagnetic radiation, and hydro-desulfurization in processing carbonaceous materials are well known. The challenge is to apply these principles using innovative and novel techniques and apparatuses to remove sulfur and heavy metals from a wide range of crude oil and petroleum products in a commercial process.

DESCRIPTION OF THE INVENTION

Before describing the present invention, it must be recognised that every crude oil has its own characteristics and variation in the form and quantity of sulfur and heavy metals. The metals and sulfur could occur as fine discrete particles mixed with the crude oil such as iron pyrites or gypsum or a wide range of organo-sulfur or organo-sulfur-metallic compounds in various configurations such as paraffinic or cyclic molecular formation. The process and apparatus of the present invention is capable of treating this very wide range of crude oil feedstock and petroleum products to produce the acceptable quality of the products at a viable capital and operating cost. By-product or waste disposable must be considered as one waste product such as calcium or sodium salt may be acceptable in one plant location but not in another plant location.

In one form therefore the invention is said to reside in a process and apparatus to extract and recover sulfur and heavy metals from crude oil or petroleum fuel products consisting of the steps of emulsifying the crude oil with an emulsifying agent, adding a leach solution to the emulsified crude oil and leaching the emulsified crude oil at elevated temperature and pressure in an appropriate leaching vessel or vessels to give a leached emulsified crude oil and a leachate, separating the leached emulsified crude oil and the leachate, removing a proportion of the leachate and recovering sulfur heavy metals therefrom, washing the leached emulsified crude oil with water and separating the leached emulsified crude oil and the washing water.

Preferably the process further includes the step of microwave hydro-desulfurizing the leached and washed crude oil using hydrogen gas at a temperature below 220 degrees Celsius to ensure there is no quality degradation in the crude feed to produce a desulfurised crude oil and a hydrogen sulphide by product; and recovering sulfur from the hydrogen sulphide by product using a commercial process.

This more expensive microwave hydro-desulfurization with the accessory plants is generally applied where the sulfur content of the crude oil or petroleum product is very high and there is a very large quantity of the crude oil to be treated. Aside from removing sulfur from compounds such as mercaptans, sulphides, disulphides and thiopenes, microwave hydro-desulfurization will also improve the product crude quality by denitrogenation of pyrroles and pyridines, deoxidation of phenols and peroxides, dehalogenation of chlorides, hydrogenation of pentenes to pentanes, and some hydrocracking of long chain hydrocarbon molecules.

Where the quantity of the acid leached crude oil or petroleum product is relatively small and the amount of sulfur to be further removed is also relatively small, the acid leached and washed crude oil may be subjected to an alkali leach with microwaves and then washed to meet final sulfur specifications. The sulfur is recovered in the waste product as sodium sulphate.

In a preferred embodiment of the invention the leaching step may comprise the steps of leaching the emulsified crude oil with an acid leach solution while microwave energy is applied, washing the acid leached emulsified crude oil with water, separating the crude oil from the wash water, re-emulsifying the crude oil as required, leaching the re-emulsified crude oil with an alkali leach solution while microwave energy is being applied, washing the alkali leached re-emulsified crude oil with water, and separating the crude oil from the wash water. The acid and alkali leached crude oil may subsequently be subjected to microwave hydro-desulfurization if required to meet product specifications.

The viscosity of the feedstock crude oil may be reduced at the beginning of the process by the addition of a solvent before emulsification and the solvent may be recovered for reuse by distillation before the process of this invention. Up to 20% by volume of a solvent may be added to the crude oil before emulsification depending on the viscosity properties of the crude oil and the solvent.

One class or more of emulsifying agents for leaching may be added at an amount of up to 0.5% by weight of the crude oil. The emulsifying agent should be sufficiently stable in acid or alkali conditions and temperature of below 160 C.

The emulsifying agents are selected so that the least amount is required to achieved emulsification and any left-over after leaching does not reduce the quality of the crude oil or petroleum product.

The leach solution may be a solution of an inorganic acid or alkali which is used in an amount of about 5 percent to 50 percent by volume of the crude oil.

The leaching process may be carried out in a vertical cylinder or a multi-compartment horizontal vessel capable of containing the pressure, temperature, and corrosive nature of the crude oil-leaching solution mixture.

The leaching may be carried out in a vessel provided with a stand pipe and an agitation mechanism consisting of an impeller and baffle assembly sufficient to circulate the mixture of crude oil-leach solution and provide intense agitation and mixing in the area where microwave energy is being applied. The washing vessels may be fitted with the same agitation mechanism but without microwave supply and operate at ambient pressure.

The leaching vessel may be provided with external insulation and internal or external means of conventional heating.

The leaching vessel may be provided with a means of applying large quantities of microwave energy at the space of intense mixing of the crude oil and the leach solution.

The leaching stage may be carried out at temperatures of between 25 C to 160 C and pressure of up to 100 bars.

Heating at the leaching step may be carried out by the application of conventional heating only, the application of microwave energy or a combination of conventional heating and microwave energy.

The leaching step may consist of one or more stages with a liquid liquid separation between stages and the leaching may be arranged in countercurrent mode.

There may be one or more stages of liquid liquid separation between the leaching step and the washing step.

The washing step may consist of one or more stages with a liquid liquid separation between stages and the washing step may be arranged in countercurrent mode.

There may be one or more stage of liquid liquid separation between the washing step and the hydro-desulfurization step.

The wash water may contain a small amount of alkali to ensure that the acid leached and washed crude oil has the best quality for the subsequent microwave hydro-desulfurization step.

The microwave energy may be applied to the leach solution at 800 to 22,000 megahertz frequency.

The leach solution may contain an inorganic acid or alkali, or include a small amount of oxidising agent such as hydrogen peroxide.

The leaching step may include anode cells in the leachate circuit to oxidise suitable ions such as ferrous and vanadium ions before the leachate is recycled to the leaching step. Aside from the acid, the ferric and vanadic ions produced from leached ferrous and vanadous ions at the anode will participate and assist in the leaching process.

The step of the recovering heavy metals may include the steps of separating a bleed solution from the main leaching stream after the anode cell, adjusting the pH of the bleed solution to about between 1.5 and 2.5 using calcium or sodium hydroxide or carbonate, applying hydrogen sulphide gas to the hot solution to precipitate base metals and other metals susceptible to this treatment and filtering the precipitate, adjusting the pH of the boiling solution to a pH of about between 3.0 to 3.5 using soda ash to precipitate compact iron oxide which is filtered from the solution, applying a small amount of an oxidising agent such as hydrogen peroxide to convert vanadium ions to their highest oxidation state before applying soda ash or ammonia to the solution to increase the pH to about 3.6 to 4.6, applying hydrogen sulphide gas to the solution to precipitate vanadium sulphide, filtering the vanadium sulphide precipitate, adjusting the pH of the hot solution to between 8 and 10 using soda ash or ammonia to precipitate vanadium hydroxide and subjecting the waste solution to a vacuum to recover any hydrogen sulphide gas left in the waste solution before the solution is discarded.

The acid leached and washed crude oil may further be treated with microwave hydro-desulfurisation or alkali leaching.

Conventional heating is used to raise the temperature of the crude oil between the washing step and the hydro-desulfurization step.

The microwave hydro-desulfurization crude oil product containing the waste product of hydrogen sulphide mixed with un-reacted hydrogen gas is cooled and the hydrogen and hydrogen sulphide gas are stripped from the crude oil. Hydrogen is separated and re-cycled to the microwave hydro-desulfurization while the hydrogen sulphide gas is fed to a conventional Claus or Stretford process to convert the hydrogen sulphide into elemental sulfur and hydrogen gas which is re-cycled to the microwave hydro-desulfurization process.

The microwave hydro-desulfurization may be carried out at temperature of up to 220 C and pressure of up to 100 bars unless higher temperature and pressure are required for increased hydro-cracking for a particular crude oil or petroleum product.

The microwave hydro-desulfurization process may be carried out in the presence of catalyst selected from cobalt and molybdenum on alumina to enhance the efficiency of the reaction or to reduce the required hydro-desulfurization temperature and pressure.

The microwave hydro-desulfurization may be carried out in a vessel comprising a vertical cylindrical vessel or a multi-compartment horizontal cylindrical vessel fitted with a standpipe and a hollow shaft for the admission of hydrogen and an impeller-baffle assembly to intensely and intimately mix the leached crude and the hydrogen gas at the space where the microwave energy is applied.

The microwave hydro-desulfurization vessel may be provided with external insulation and internal or external source of conventional heating.

The microwave energy applied to the microwave hydro-desulfurization vessel may range between 880 and 22,000 megahertz where the most efficient frequency is determined experimentally for each crude oil sample.

The microwave hydro-desulfurization vessel may be fitted with microwave generators and wave guides through quartz windows at the bottom or sides of the microwave hydro-desulfurization vessel. Alternatively the microwave energy for the hydro-desulfurization step is applied in a series of pipes where the crude oil is being circulated from a holding vessel. In a further arrangement the microwave energy for the hydro-desulfurization step may applied to the crude oil through wave guides inside the vessel and wherein the microwave energy is delivered to the crude oil through slots in the wave guide. Alternatively the microwave energy for the hydro-desulfurization may be delivered at the end of several short wave guides inside the vessel under convection tubes at a space where there is maximum intense and intimate mixing of the crude oil and hydrogen gas. The microwave energy for the hydro-desulfurization may be delivered at the end of antennae inside the vessel under convection tubes at a space where there maximum intense and intimate mixing of the crude oil and hydrogen gas.

BRIEF DESCRIPTION OF THE DRAWINGS

This then generally describes the invention but to assist with understanding reference will now be made to preferred embodiments as illustrated in the accompanying drawings.

DISCUSSION OF PREFERRED EMBODIMENTS

Figure 1:
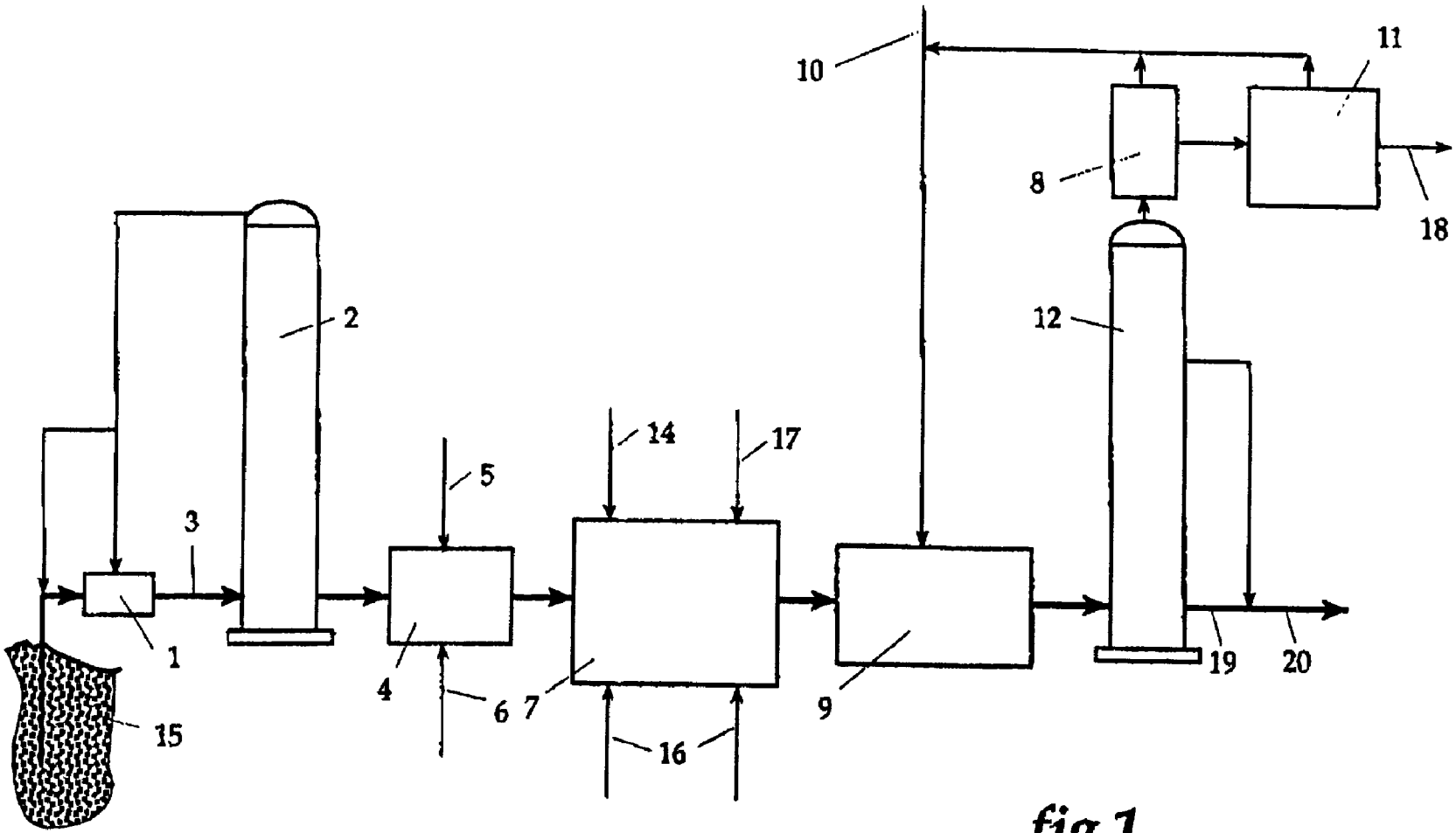
FIG. 1 shows a flow sheet of a crude oil treatment process according to one embodiment of the present invention applying hydro-desulfurization after the acid leach.

FIG. 1 shows a flow chart for the preferred sequence of removing heavy metals and sulfur from a heavy sour crude oil. The microwave assisted leaching process for the crude oil will make the crude oil more susceptible for the low temperature microwave hydro-desulfurization to remove more sulfur. The process is best carried out at the oil field where the sour crude is produced because piping the viscous sour crude is difficult and the sour crude causes severe corrosion on a pipeline.

Heavy sour crude from well 15 is usually very viscous and it may be necessary to add a solvent or a cutting agent in mixer 1 to make the crude oil sufficiently fluid to pipe it to a central sulfur and heavy metals processing plant. The solvent may be injected into the well or mixed at the surface. The large amount of solvent can be reduced by distillation 2 by heating the crude oil after it has been transferred in pipeline 3 to the processing site. Recovered solvent is recycled to the mixer or to the well.

The crude oil is then emulsified by mixing in a mixer 4 with emulsifying agents 5 and water 6.

Water based leaching solution 14 is added in the leaching step. The microwave leaching apparatus 7 must be capable of high pressure and resist the corrosive mixture of the crude and leach solution. A crude oil whether it is easy or difficult to leach will contain sulfur and metallic compounds that are easy to leach and compounds which are difficult to leach. A proportion of the leach solution is extracted and chemicals added 17 as will be discussed later for extraction of metals and sulfur compounds 16.

After leaching and washing the crude oil is transferred to a microwave hydro-desulfurizing stage 9. Hydrogen is added at 10 and after treatment as will be discussed in more detail later, the desulfurized oil is cooled before hydrogen sulphide and excess hydrogen is removed in stripper 12. Hydrogen and hydrogen sulphide are separated and the hydrogen sulphide is treated at stage 11 to give elemental sulfur 18. Hydrogen is recycled to the hydrogen supply 10 to the desulfurisation step.

The cleaned crude oil 19 and any light fraction separated in the stripper are remixed to form the final clean oil product 20.

Figure 2:
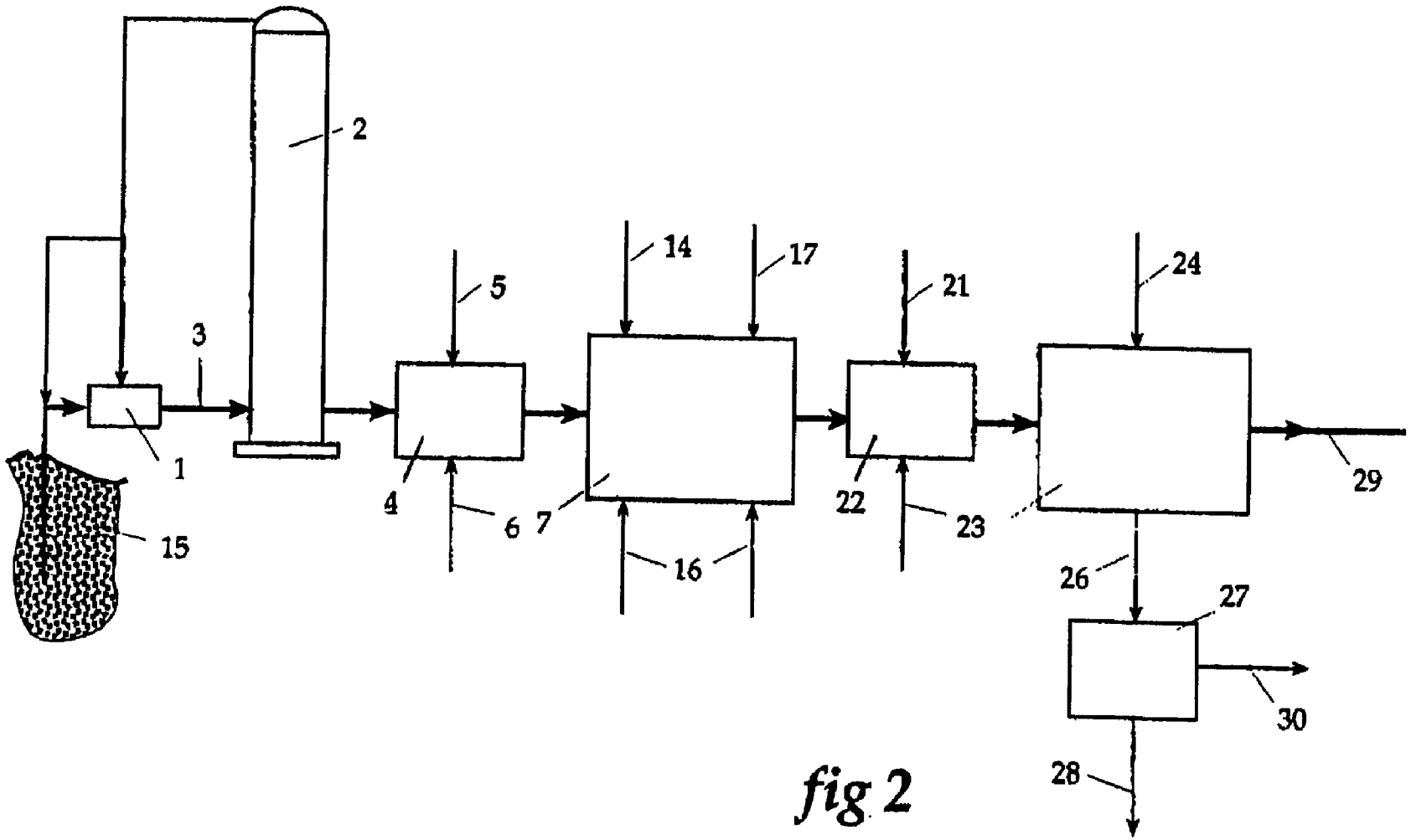
FIG. 2 shows a flow sheet of a crude oil treatment process according to an alternative embodiment of the present invention applying acid leaching and alkali leaching.

FIG. 2 shows an embodiment of this process where the microwave hydro-desulfurization is replaced by alkali leaching of the sulfur left after acid leaching. The process is the same as in FIG. 1 until after the washing stage. The acid leached and washed crude oil is changed into mixer 22 where emulsifying agents 21 and water 23 are added. Caustic soda or soda ash 24 is added for the alkali leaching process 25 using either or both conventional heat and microwave energy. After liquid liquid separation and washing the leach solution and wash water 26 are evaporated 27 to separate the excess caustic soda 30 and the sodium sulfur salts 28. The clean oil 29 is delivered to the storage or pipeline.

Figure 3:
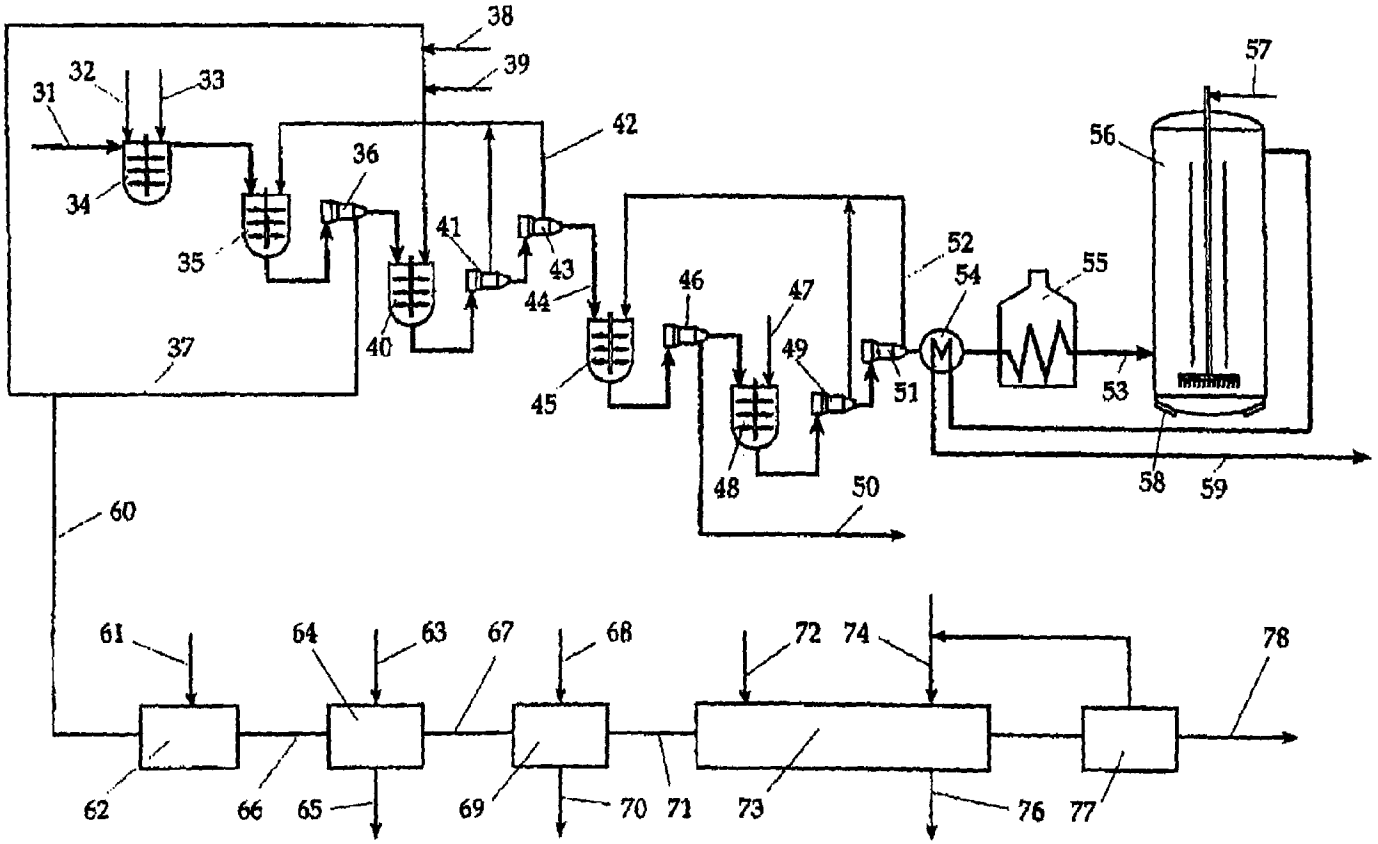
FIG. 3 shows a more detailed diagram of a process according to an alternative embodiment of the present invention of the acid leaching followed by hydro-desulfurization of a crude oil or petroleum product.

FIG. 3 shows an embodiment of this invention consisting of acid leaching and microwave hydro-desulfurization and the recovery of the metals. Crude oil or petroleum product 31 is delivered to mixer 34 where emulsifiers 33 and water 32 are added. The mixing along with recycled leachate 42 is delivered to first leach vessel 35 which applies conventional heating and pressure to the mixture. After leaching, liquid liquid separation of the mixture is carried out using a device such as a liquid vortex separator 36 where the partially leached crude oil is discharged into a second acid leaching stage and the leachate 37 is delivered to the next leach stage where the leaching vessel 40 is provided with a microwave energy generator. Acid make-up 38 and an oxidising agent 39 such as hydrogen peroxide are added to leach vessel 40. To ensure maximum removal of the leachate, the product mixture from leach vessel 40 is subjected to two or more liquid liquid separation stages where the leachate 42 is recycled to leach vessel 35 and the acid leached crude oil 44 is delivered to the washing section mirror 45 with the wash liquor 52 from the second stage wash 51. The mixture from mixer 45 is passed through a liquid liquid separator 46 where the partially washed crude oil is delivered to mixer 48 and the wash liquor 50 is delivered to the weak acid water storage to be used in making acid solutions in the leaching stage. Wash water 47 which may contain some alkali is added to mixer 48. The mixture from mixer 48 is passed through two or more liquid liquid separation units 49 and 51 to ensure maximum removal of wash water with the first wash water 52 delivered to the first wash mixer 45. The leached and washed crude oil 53 is passed to the heat exchanger 54 and then to the heater 55 before processing in the microwave hydro-desulfurization vessel 56 where hydrogen 57 and microwave energy 58 is applied. The hydro-desulfurized oil 59 is delivered to a hydrogen sulphide stripping section (not shown).

For metals recovery, allowing the metal concentration in the leachate 37 to build up will improve metals recovery and reduce acid loses during metals recovery. A bleed stream 60 is taken from leachate stream 37 and delivered to mixer 62 where the pH of the solution is adjusted to 1.5 to 2.5 with lime or soda ash 61 before hydrogen sulphide gas 63 is applied to the hot solution 66 in mixer 64. Base metal and other metal sulphides 65 are precipitated and filtered. The filtrate 67 is heated to boiling and the pH is adjusted to between 3 to 3.5 with soda ash 68 in mixer 60 resulting in the precipitation of iron as a compact iron oxide 70. After filtering, the clear solution 71 is delivered to the vanadium recovery section 73 where the vanadium ions are oxidised to their highest valency of 5+by adding oxidising agents such as hydrogen peroxide 72. After adjusting the pH of the solution with soda ash or ammonia 74 to about 3.6 to 4.6, hydrogen sulphide 75 is applied to the solution where some of the vanadium precipitates as sulphides 76. After filtration, the pH is further adjusted to between 8 to 10 with soda ash or ammonia causing the rest of the vanadium to precipitate as an oxide 76. Vacuum 77 is applied to the waste solution to recover hydrogen sulphide gas before the waste solution 78 containing mainly calcium, sodium and some ammonium sulphate is delivered to the waste pond.

Figure 4:
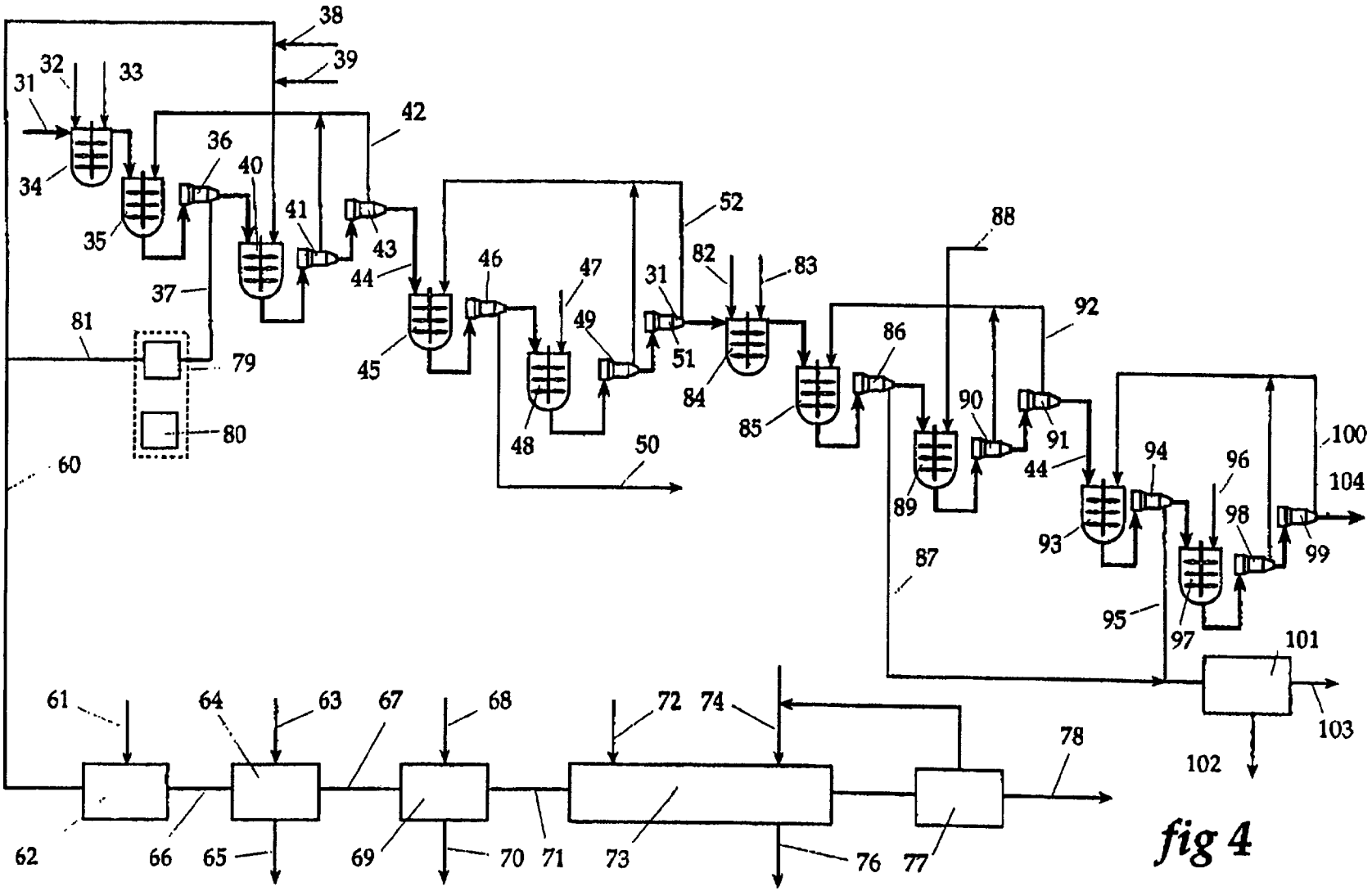
FIG. 4 shows a more detailed diagram of a process according to an alternative embodiment of the present invention of acid and electro-leaching followed by alkali leaching of a crude oil or petroleum product.

FIG. 4 is an embodiment of this invention where the heavy metals and some sulfur is removed by acid leaching and electro-leaching and further removal is carried out by an alkali leach of the acid leached crude oil. The acid leaching and washing is similar to FIG. 3 except that instead of adding an oxidising agent 39 during leaching, the leach solution 37 is passed through the anode cells 79 of an electrolyte system of the type disclosed in Applicants U.S. Pat. Nos. 5,569,370 and 5,882,502 and Australian patents 654774 and 707701, oxidising ions such as iron and vanadium allowing these ions to participate in the leaching process. Another acid solution could be circulated though the cathode cells 80 of the electrolytic system to produce hydrogen gas for use in the process of this invention. The washed acid leached crude oil is delivered to mixer 84 where the emulsifiers 82, if required and water 83 are added. The mixture is leached in leach vessel 85 using conventional heating and then passed to the liquid liquid separator 86 where the leachate 87 is subjected to evaporation 101 to separate the caustic soda 102 for recycle and the sulfur salts 103 which are delivered to the waste pond. The partially leached crude oil is then leached in vessel 89 with caustic soda 88 with application of microwave energy. The leachate is then removed in a double stage liquid liquid separation 90, 91 with the removed leachate 92 being recycled to the first alkali leach vessel 85. Subsequently the crude oil is passed to a two stage washing system in mixers 93, 97 with washing water added at 96 and intermediate drying at 94 and final double stage liquid liquid separation 98, 99 with the wash water 100 being recycled and the leached crude oil product 104 being delivered to storage, a pipeline or for refining as required.

The metals recovery is similar to the process shown and described in FIG. 3 after a blend stream 60 is taken from the leach liquor stream 81.

Figure 5:
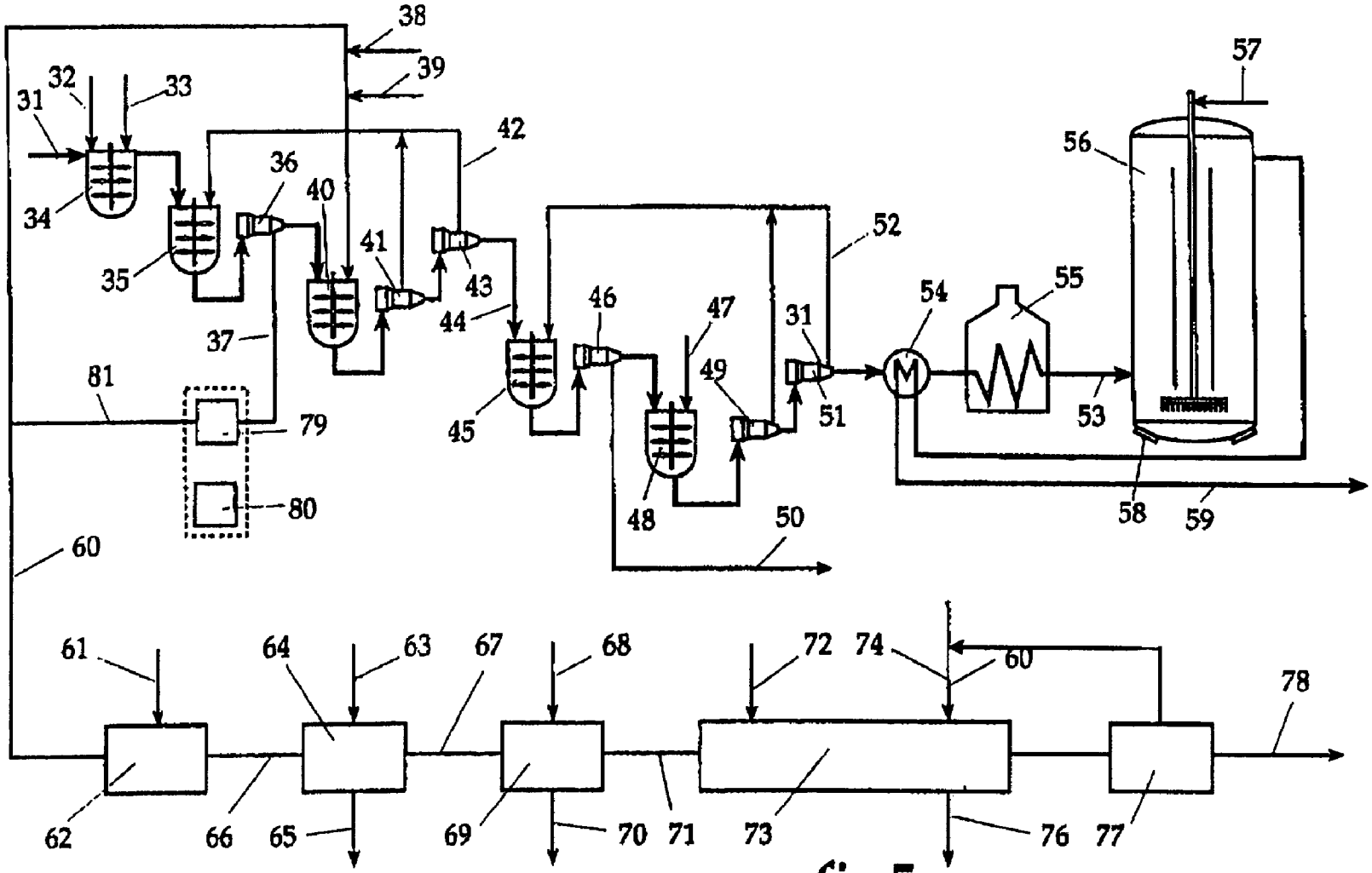
FIG. 5 shows a diagram of a process according to an alternative embodiment of the present invention of the acid leaching and electro-leaching followed by hydro-desulfurization of a crude oil or petroleum product.

FIG. 5 is another example of the application of this invention where the metals and sulfur are leached with acid and electro-leaching before microwave hydro-desulfurization. The illustration is similar to FIG. 3 except the oxidising power of the anode cells is used to oxidise ions in the leach liquor such as iron and vanadium to their higher valency state so that these ions will participate in the leaching process. Leach liquor 37 is passed through the anode cells before a bleed stream 60 is taken from oxidised leached liquor 81. This embodiment of our invention will result in lower acid consumption and higher leach efficiency for some crude oils.

Figure 6:
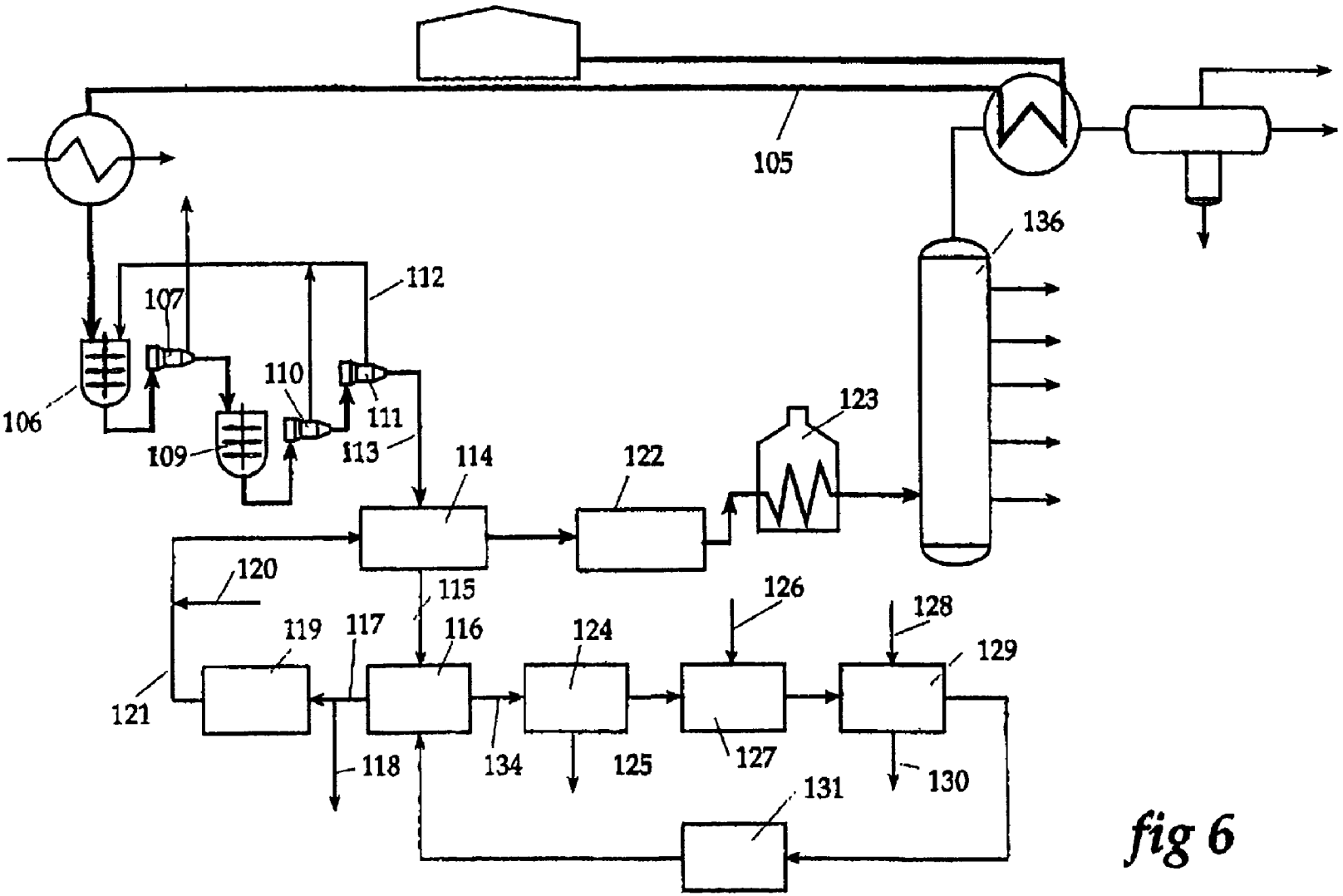
FIG. 6 shows a diagram of a process according to the present invention of acid leaching followed by alkali leaching and using solvent extraction for the recovery of metals from a refinery feedstock.

FIG. 6 is an application of our invention using solvent extraction in the recovery of the metals. FIG. 6 shows a 2-stage de-salting operation using liquid vortex separations but this operation normally can be eliminated as the acid leaching will perform the de-salting function.

The crude feedstock 105 is mixed with the second stage wash 112 in mixer 106. The mixture is fed into a vortex separator 107 for liquid liquid separation where the salty water 133 with some solids is sent to the waste pond and the crude oil is delivered to the first wash mixer 109 where water 108 is added. The mixture from mixer 109 is subjected to two stages of liquid liquid separation 110 and 111 before the de-salted crude oil 113 is processed in the acid leach and washing section 114 and then to the alkali leaching and washing section 122 before the washed oil 132 is passed to the heater 123 for subsequent refining in distillation column 136 for instance.

The acid leach liquor 115 or a bleed stream is processed in the solvent extraction process 116 where metal ions are transferred to the strip solution 134. Because metals can be plated out from the solution 134 by the cathode cells 124 or alternatively precipitated by applying hydrogen sulphide. The pH of the solution from the cathode cells 124 is adjusted and oxidised with oxidising agent 126 in mixer 127 before hydrogen sulphide 128 is applied in mixer 129 to precipitate the vanadium compounds 130. Vacuum 131 is applied before solution 135 is returned for stripping duty in the solvent extraction process. Stream 117 is oxidised in anode cells 119 and make-up acid 120 added before the leach solution 121 is recycled to the acid leaching circuit. Iron is not removed in the solvent extraction process and a bleed stream 118 is removed from stream 117 for neutralisation and recovery of the iron.

Figure 7A:
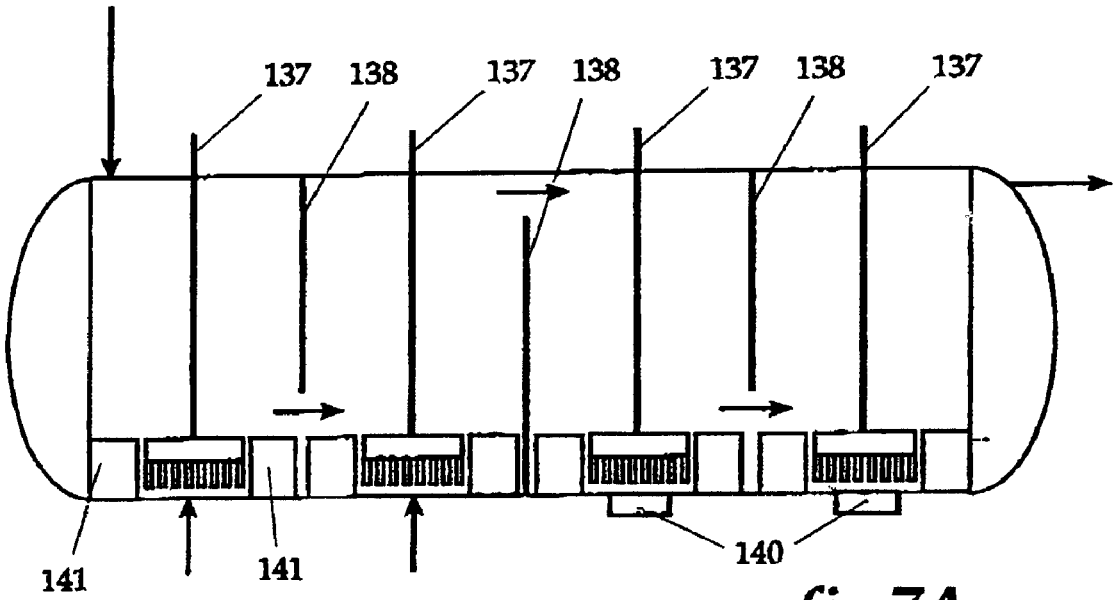
FIG. 7A shows one embodiment of a leach vessel suitable for the present invention.

A simple leaching apparatus is shown on FIG. 7A. The leaching apparatus has a horizontal cylinder 139 with means to apply conventional heating 138 in a first few stages of the vessel and means to apply microwave energy 140 into the cylinder towards the latter part of the vessel with the microwave energy 140 being fed through an external quartz window 141 at the point of greatest turbulence. Intense turbulence and shearing of the leach mixture is achieved by a series of agitators 137 each consisting of an impeller with vertical fingers at the edge of a circular plate acting against closely located stabilisers 141. Baffles separate each agitation compartment to minimise short-circuiting of the mixture.

Figure 7B:
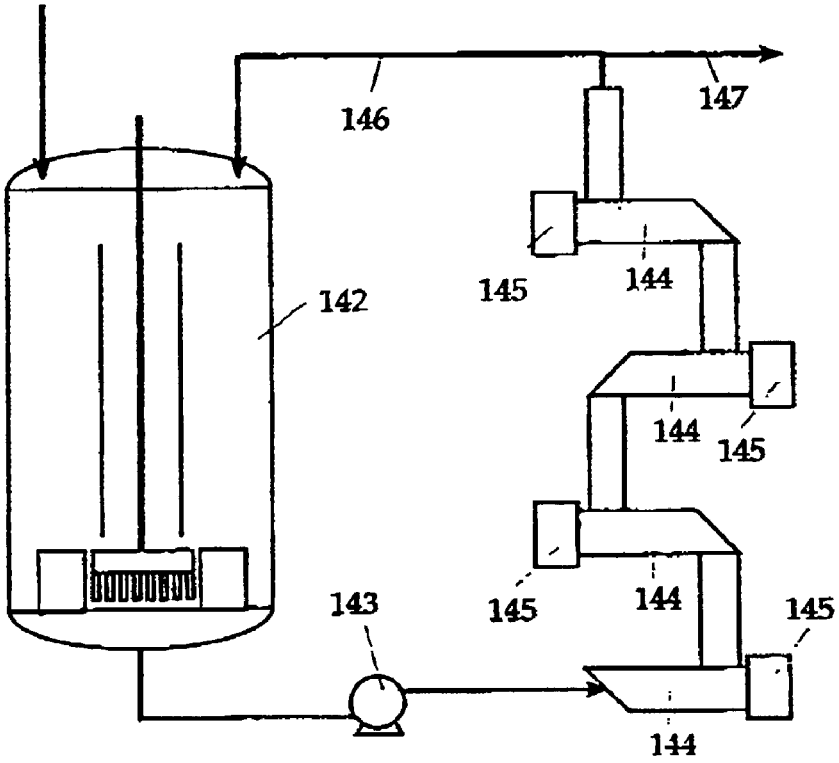
FIG. 7B shows an alternative embodiment of a leach vessel suitable for the present invention.

A pipe method of microwave application is shown on FIG. 7B. Leach solution and crude oil is circulated from a heated leach vessel 142 by pump 143 to several pipe microwave units 144. Each pipe microwave unit 144 has a microwave magnetron 145 to supply microwave energy to the liquid mixture in the pipe. The end of each of the pipes 144 is inclined at 45 degrees to reflect the microwaves into the mixture of crude and leach solution and prevent bouncing back to the magnetron. After treatment with microwave energy some material is recycled 146 and some is transferred to the next stage 147.

Figure 8A:
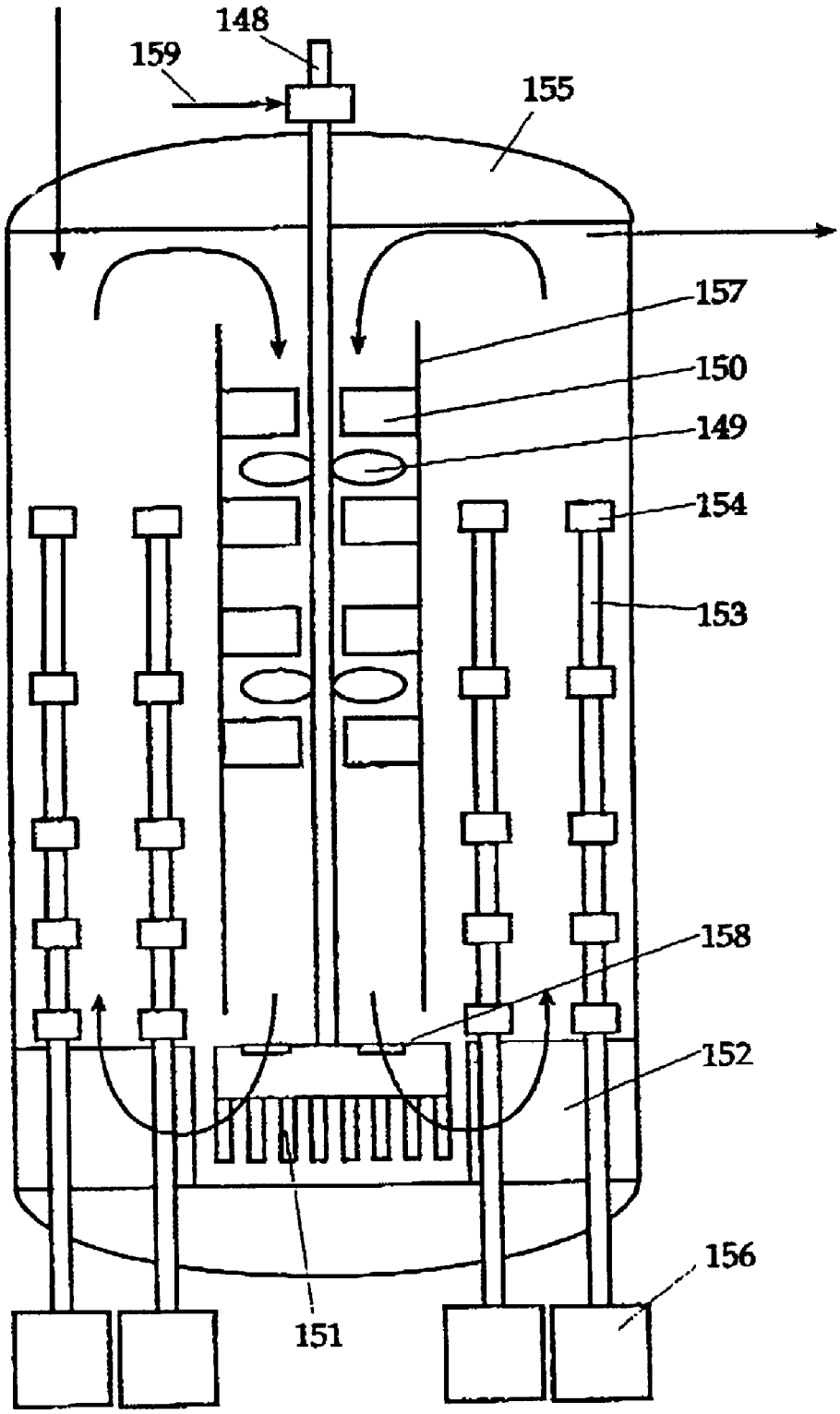
FIG. 8A shows one embodiment of a reaction vessel suitable for the present invention.
Figure 8B:
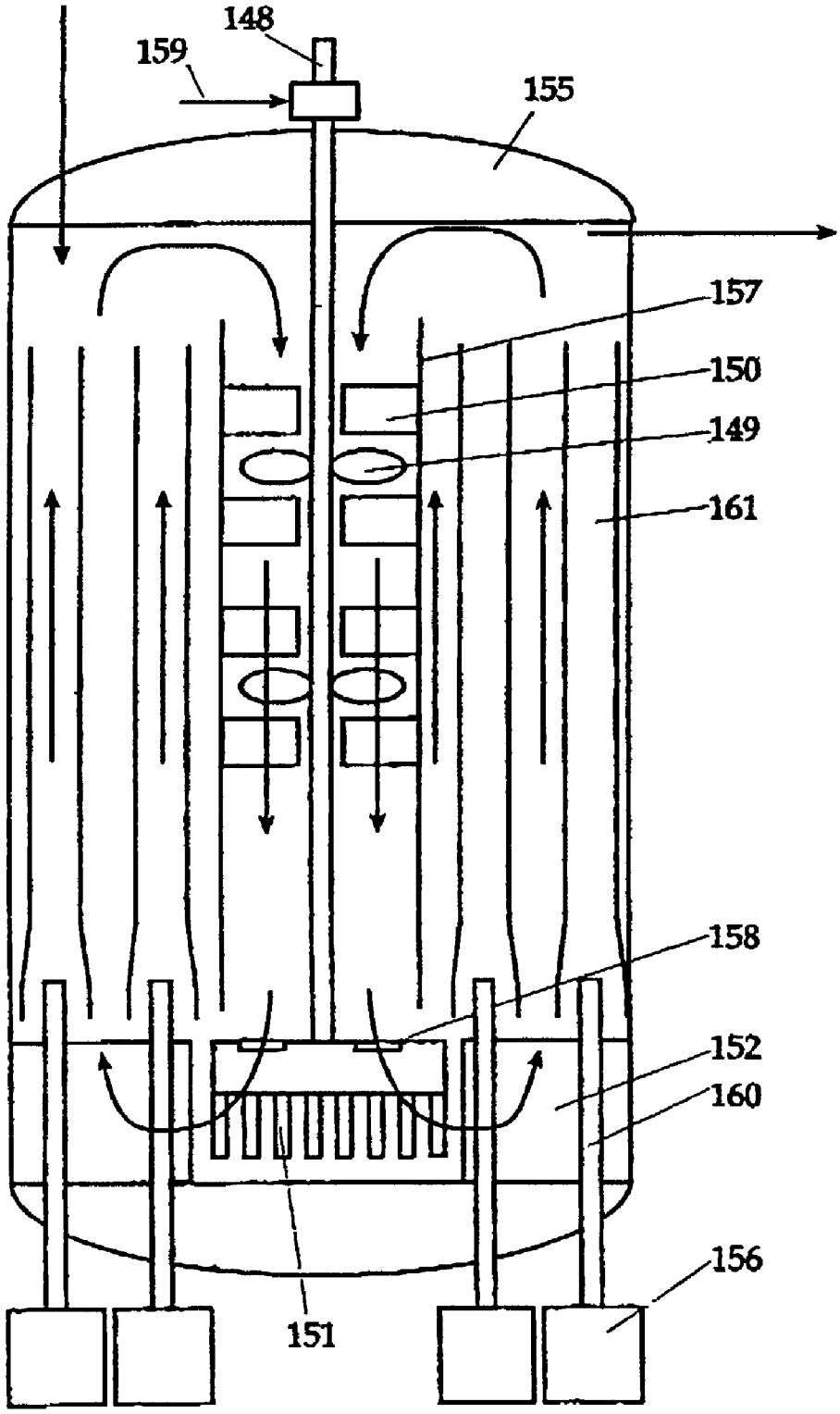
FIG. 8B shows an alternative embodiment of a reaction vessel suitable for the present invention.
Figure 8C:
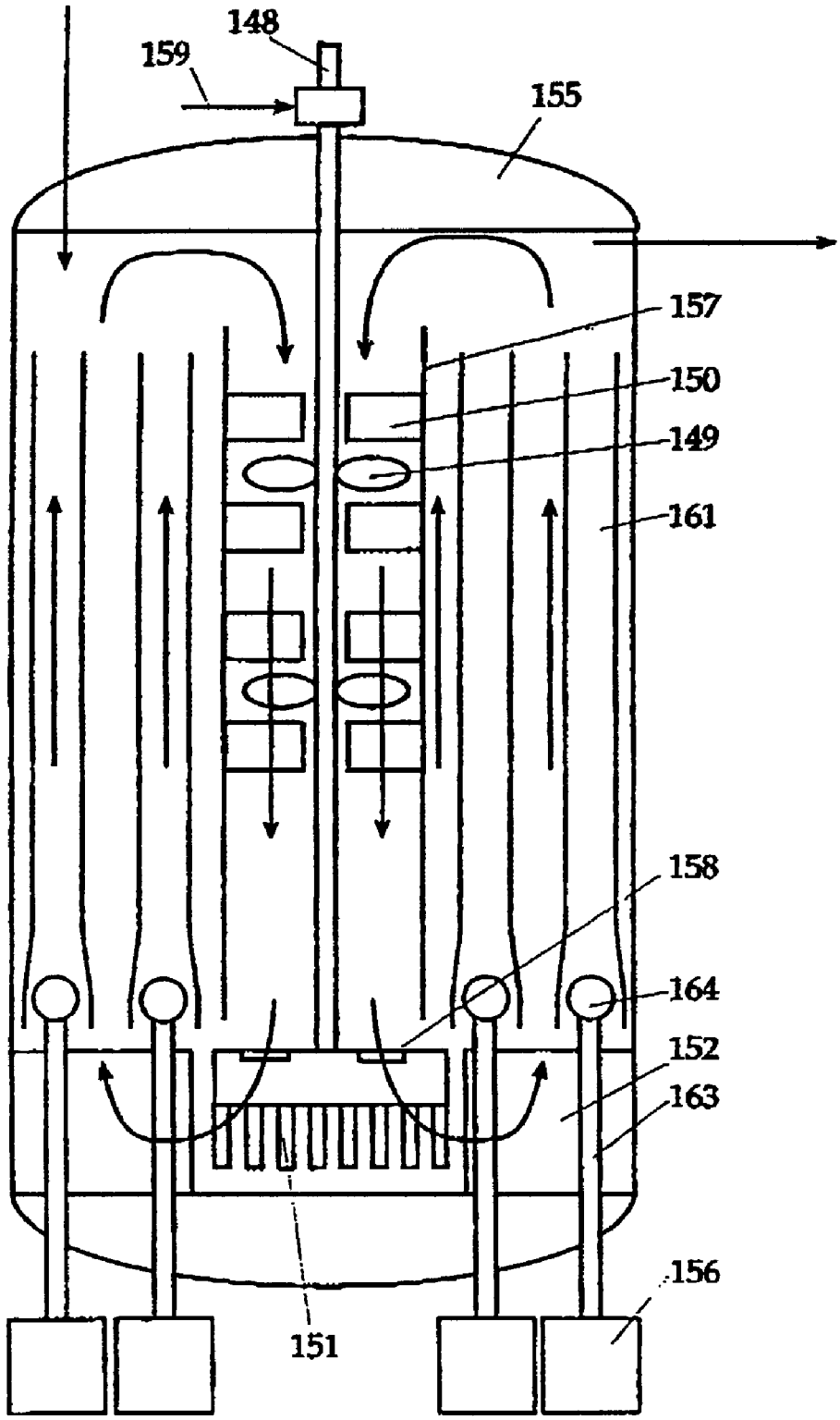
FIG. 8C shows a further embodiment of a reaction vessel suitable for the present invention.

The apparatus shown in FIGS. 8A, 8B, and 8C are suitable for high capacity leaching as well as for hydro-desulfurisation which require a different method of applying the microwave to the mixture. The features of FIGS. 8A, 8B, and 8C can also be applied to a large compartmentalised horizontal cylindrical apparatus as in FIG. 7A.

When the apparatus shown in FIGS. 8A, 8B and 8C is used for leaching the apparatus includes an impeller shelf 148 which is solid and which drives intermediate impeller 149 along the shaft and an impeller 151 at the bottom of the shaft. Baffles 150 near each intermediate impeller assist with the intense mixing of crude oil and leach solution thereby giving very good contact and very intense agitation and shearing of the liquid mixture is achieved by the bottom impeller 151 against the stabilisers 152. General circulation of the mixture in the leach vessel is achieved by the aid of the stand-pipe 157, the intermediate impellers 149, and the holes 158 on the circular plate of the bottom impeller.

The supply of microwaves to the vessel 155 in FIG. 8A is by means of a series of magnetrons 156 and wave guides 153 extending into the vessel 155. The microwaves are distributed along the wave guide by means of several slotted wave guides 153 where the slots 154 include quartz, ceramic or Teflon covers. The slots 154 for dispersing the microwaves are closer at the bottom and further apart towards the top of the apparatus. A large amount of microwave energy can be applied to the charge by this method rather than using the window method as shown in FIG. 7A.

In FIG. 8B is an alternative embodiment of reaction vessel for leaching or hydro-desulfurizing. In this embodiment the microwave feeding method uses a short wave guide 160 above the magnetron 156 and a convection tube 161 above each wave guide. The wave guide has a window 162 of ceramic, quartz or plastics material through which the microwave energy is released. This method concentrates the microwaves into the most intense turbulent area of the apparatus.

In FIG. 8C an alternative method of supply of microwave energy is shown. In this embodiment the magnetrons 156 each have a shielded cable conductor 163 in the form of an antenna extending from the magnetron 156 below the reaction vessel into the bottom of the convection tubes 161 with a microwave window at the top of the antenna 164.

When used for leaching as discussed above the apparatus shown in FIGS. 8A, 8B and 8C do not require a hollow shaft, however, when the same apparatus is used in the hydro-desulfurisation process the shaft 148 can be hollow so that hydrogen gas 159 can be supplied down the hollow shaft to be mixed intimately with the crude oil by the bottom impeller in the region that the microwaves are applied. By this means maximum contact of hydrogen gas with crude oil is achieved.

EXPERIMENTAL RESULTS

Leaching

Microwave leaching tests were carried out using a 3-liter autoclave fitted with a 1.2 kw microwave generator at 2450 megahertz frequency where the microwaves are inserted into the autoclave through a quartz window at the bottom of the autoclave. The samples tested are a very fluid reduced crude from the Middle East with a specific gravity of 0.8418 at 36 C and a commercially available emulsified bitumen containing 40 to 45 percent water which had a specific gravity of 0.9851 at 28 C and an unknown uncut bitumen.

Leaching tests were carried out with an over-pressure of 8 bars of nitrogen with sulfuric acid of 30% strength at 7.5% by volume. The samples absorbed microwaves readily during the test which range in temperature from 80 to 140 degrees Celsius. Higher temperatures resulted in the sulfuric acid reacting with the oil. The best extractions obtained based on the analysis of the feed and the leached crude were:

| | Sulfur | Vanadium | Nickel | Iron |
|---|---|---|---|---|
| Crude | 86.44 | 86.44 | 94.58 | 97.29 |
| Emulsified Bitumen | 50.00 | 75.00 | 77.78 | 60.00 |

We anticipate higher extraction rates than reported above because the low rpm centrifuge used in the above tests was not efficient in separating the leachate from the crude oil. Tests on the uncut bitumen were discarded because high temperatures (greater than 165 C) were used which resulted in the acid reacting with the bitumen.

The results indicated that the removal of sulfur and heavy metals is much easier for lighter crude but more difficult for heavy crude. The addition of small amounts of an oxidising agent such as hydrogen peroxide is expected to increase the extraction of vanadium based on tests in applicant's laboratory on recovering vanadium from a complex iron ore.

What is claimed is:

1. A process to extract and recover heavy metals and sulfur from crude oil or petroleum fuel products comprising:

emulsifying the crude oil with an emulsifying agent;

adding a leach solution containing an inorganic acid or alkali to the emulsified crude oil and leaching the emulsified crude oil at an elevated temperature and pressure to provide a leached emulsified crude oil and a leachate;

separating the leached emulsified crude oil and the leachate;

removing a proportion of the leachate;

recovering sulfur or heavy metals from the leachate;

washing the leached emulsified crude oil with water; and separating the leached emulsified crude oil and the washing water wherein the leaching step is carried out during the application of microwave energy.

2. A process to extract and recover heavy metals and sulfur from crude oil or petroleum fuel products comprising:

emulsifying the crude oil with an emulsifying agent;

adding a leach solution containing an inorganic acid to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water; and further leaching the acid leached and washed crude oil or petroleum product with an alkali solution while being irradiated with microwaves to remove sulfur from the crude oil.

3. A process to extract and recover heavy metals and sulfur from crude oil or petroleum fuel products comprising:

emulsifying the crude oil with an emulsifying agent;

adding a leach solution containing an inorganic acid or alkali to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water; and microwave hydro-desulfurizing the leached and washed crude oil using hydrogen gas at a temperature below about 220° C. to ensure there is no quality degradation in the crude oil to produce a desulfurized crude oil and a hydrogen sulfide by-product; and recovering sulfur from the hydrogen sulfide by-product.

4. The process of claim 1, wherein viscosity of the crude oil is reduced by addition of a solvent before the emulsifying step and the solvent is recovered for reuse by distillation before the leaching step.

5. The process of claim 4, wherein up to 20% by volume of the solvent is added to the crude oil before the emulsifying step.

6. The process of claim 1, where up to 0.5% by weight of emulsifying agents is mixed with the crude oil or petroleum product before the leaching step.

7. The process of claim 1, wherein the leaching step is carried out at temperatures of between about 25° C. to 160° C. and pressure up to about 100 bars.

8. The process of claim 1, wherein the leaching step is carried out during the application of conventional heat.

9. A process to extract and recover heavy metals and sulfur from crude oil petroleum fuel products comprising:

emulsifying the crude oil with an emulsifying agent;

adding a leach solution containing an inorganic acid or alkali to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water; and wherein the leaching step is carried out during the application of both conventional heat and microwave energy.

10. The process of claim 1, wherein the leaching step comprises one or more stages with a liquid-liquid separation between stages and wherein the leaching step is conducted in a counter-current mode.

11. The process of claim 1, further including one or more stages of liquid-liquid separation between the leaching step and the washing step.

12. The process of claim 1, further including one or more stages of liquid-liquid separation between the crude oil and a rich leachate.

13. The process of claim 1, wherein the washing step comprises one or more stages with a liquid-liquid separation between stages and wherein the washing step is conducted to counter-current mode.

14. The process of claim 3, further including one or more stages of liquid-liquid separation between the washing step and the microwave hydro-desulfurizing step.

15. The process of claim 2, wherein the alkali leaching step is carried out during the application of both conventional heat and microwave energy.

16. The process of claim 1, wherein the microwave energy is applied to the leach solution at about 800 to 22,000 megahertz frequency.

17. A process to extract and recover heavy metals and sulfur from crude oil petroleum fuel products comprising:

emulsifying the crude oil with an emulsifying agent;

adding a leach solution containing an inorganic acid to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water; and wherein the leach solution contains an inorganic acid and includes a small amount of an oxidizing agent including hydrogen peroxide.

18. A process to extract and recover heavy metals and sulfur from crude oil or petroleum fuel products comprising:

emulsifying the crude oil with an emulsifying agent;

adding a leach solution containing an inorganic acid or alkali to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water; and wherein the leaching step includes placing anode cells in contact with the leachate to oxidize ions including ferrous and vanadium ions before the leachate is recycled.

19. A process to extract and recovery heavy metals and sulfur from crude oil or petroleum fuel products comprising:

emulsifying the crude oil with an emulsifying agent;

adding a leach solution containing an inorganic acid or alkali to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water;

separating the leached emulsified crude oil and the washing water;

wherein the recovering sulfur or heavy metals step includes separating a bleed solution from a main leaching stream after an anode cell;

adjusting the pH of the bleed solution to about between 1.5 and 2.5 using calcium or sodium hydroxide or carbonate;

applying hydrogen sulfide gas to the solution to precipitate metals and filtering the precipitate;

adjusting the pH of the boiling solution to about between 3.0 to 3.5 using soda ash to precipitate iron oxide and filtering the iron oxide precipitate from the solution;

applying an oxidizing agent including hydrogen peroxide to convert vanadium ions to their highest oxidation state before applying soda ash or ammonia to the solution to increase the pH to about 3.6 to 4.6;

applying hydrogen sulfide gas to the solution to precipitate vanadium sulfide and filtering the vanadium sulfide precipitate;

adjusting the pH of the hot solution to between about 8 and 10 using soda ash or ammonia to precipitate vanadium hydroxide; and subjecting the waste solution to a vacuum to recover any remaining hydrogen sulfide gas.

20. The process of claim 3, wherein the hydro-desulfurizing step is carried out with catalysts including cobalt or molybdenum on alumina.

21. The process of claim 3, wherein the hydro-desulfurizing waste product of hydrogen sulfide is processed in a conventional Claus or Stretford process to convert the hydrogen sulfide into elemental sulfur and hydrogen gas which is re-cycled to the microwave hydro-desulfurizing step.

22. The process of claim 3, wherein the microwave hydro-desulfurizing step is carried out in a high pressure and high temperature apparatus, the apparatus being provided with a supply of both conventional heating and microwave energy, fitted with a hollow shaft for the introduction of hydrogen gas, and an impeller and baffle assembly to break-up the crude oil into fine particles to provide intense mixing with the hydrogen gas and exposure to the microwave energy.

23. The process of claim 1, wherein the emulsifying agents are applied in amounts up to about 0.5% by weight of the crude oil, the agents being sufficiently stable in acid and alkali conditions and temperatures below 160° C.

24. The process of claim 1, wherein the leach solution is a solution of an inorganic acid or alkali which is about 5 percent to 50 percent by volume of the crude oil.

25. The process of claim 1, wherein the leaching is carried out in a vertical cylinder or a multi-compartment horizontal cylindrical vessel designed to function in the pressure, temperature, and corrosive nature of the crude oil leaching solution mixture.

26. The process of claim 1, wherein the leaching is carried out in a leaching vessel provided with a stand pipe and an agitation mechanism comprising an impeller and baffle assembly sufficient to circulate the mixture of crude oil-leach solution and provide intense agitation and mixing in the area where microwave energy is being applied.

27. The process of claim 1, wherein the leaching vessel is provided with external insulation and internal or external heating.

28. The process of claim 1, wherein the wash water contains alkali to ensure that the leached and washed crude oil has the best quality for subsequent microwave hydro-desulfurizing.

29. The process of claim 3, wherein conventional heating is used to raise the temperature of the crude oil between the washing step and the hydro-desulfurizing step.

30. The process of claim 3, wherein the microwave hydro-desulfurizing step is carried out at temperature of up to about 220° C.

31. The process of claim 3, wherein the microwave hydro-desulfurizing step is carried out in the presence of a catalyst including cobalt or molybdenum on alumina.

32. The process of claim 3, wherein the microwave hydro-desulfurizing step is carried out in a vessel comprising a vertical cylindrical vessel or a multi-compartment horizontal cylindrical vessel fitted with a standpipe and a hollow shaft for the admission of hydrogen and an impeller-baffle assembly to intensely and intimately mix the leached crude and the hydrogen gas at the space where the microwave energy is applied.

33. The process of claim 32, wherein the microwave hydro-desulfurizing vessel is provided with external insulation and internal or external housing.

34. The process of claim 32, wherein the microwave energy applied to the microwave hydro-desulfurizing vessel ranges between about 800 and 22,000 megahertz.

35. The process of claim 32, wherein the microwave hydro-desulfurizing vessel is fitted with microwave generators and wave guides through quartz windows at the bottom or sides of the microwave hydro-desulfurizing vessel.

36. The process of claim 3, wherein the microwave energy for the hydro-desulfurizing step is applied in a series of pipes where the crude oil is being circulated from a holding vessel.

37. The process of claim 3, wherein the microwave energy for the hydro-desulfurizing step is applied to the crude oil through wave guides inside the vessel and wherein the microwave energy is delivered to the crude oil through slots in the wave guides.

38. The process of claim 3, wherein the microwave energy for the hydro-desulfurizing step is delivered at the end of several short wave guides inside the vessel under convection tubes at a space where there is maximum intense and intimate mixing of the crude oil and hydrogen gas.

39. The process of claim 3, wherein the microwave energy for the hydro-desulfurizing step is delivered at the end of antennae inside the vessel under convection tubes at a space where there is maximum intense and intimate mixing of the crude oil and hydrogen gas.

40. The process of claim 1, wherein a bleed stream from a main leaching stream is separated continuously and fed to the recovering step.

41. The process of claim 18, wherein a bleed stream from a main leaching stream is separated continuously and fed to the recovering step wherein the bleed stream is separated after the anode cells.

42. The process of claim 40, wherein the pH of the bleed stream is adjusted to between about 1.5 to 2.5 using calcium or sodium hydroxide or carbonates.

43. The process of claim 42, wherein hydrogen sulfide is applied under pressure to the pH-adjusted bleed stream to precipitate base and precious metals.

44. The process of claim 43, wherein the metal sulfide precipitate is separated from the bleed stream by settling and filtration.

45. The process of claim 44, wherein the bleed stream is brought to boiling and is pH-adjusted to between about 3.0 to 3.5 using soda ash to precipitate the iron as a compact iron oxide which is then separated by filtration.

46. The process of claim 45, wherein the solution is treated with an oxidizing agent including hydrogen peroxide to convert the vanadium to its highest valence of +5 before adjusting the pH of the hot solution to between about 3.6 and 4.6 using soda ash or ammonia.

47. The process of claim 46, wherein the solution is subjected to hydrogen sulfide under pressure to precipitate vanadium sulfide, the vanadium sulfide being separated by settling and filtration.

48. The process of claim 47, wherein the pH of the solution is adjusted to between about 8 and 10 using soda ash or ammonia to precipitate the remaining vanadium and to provide a clear solution.

49. The process of claim 48, where the clear solution is subjected to vacuum to recover hydrogen sulfide gas before discarding the solution.

50. The process of claim 3, wherein the microwave hydro-desulfurizing step is carried out before the emulsifying and leaching steps.

51. A process to extract and recover heavy metals and sulfur from crude oil or petroleum fuel products comprising making the crude oil readily broken down into very small particles by applying solvents and emulsifiers to facilitate an intimate contact between the crude oil and a leaching solution during leaching, providing an apparatus designed to withstand corrosive conditions, temperatures of up to 160° C. and pressures up to 100 bars and fitted with a standpipe, impeller, and baffles to break-up the crude oil into very small particles and intimately mix the crude oil particles and the leaching solution, and utilizing the apparatus to apply heat and microwaves at about 800 to 22,000 megahertz frequency to the crude oil-leach solution mixture to achieve the desired reaction temperature, wherein the leaching comprises one or more stages with a liquid-liquid separator between stages arranged in counter-current mode, the leach solution contains an inorganic acid or alkali or an oxidizing agent including hydrogen peroxide, a washing step that contains one or more washing stages with liquid-liquid separators between stages arranged in counter-current mode where the wash water is supplied with alkali to ensure the leached and washed crude oil is ideal feed for microwave hydro-treating or refining, and the leached and washed crude oil, if it contains sulfur above a desired level, is subjected to microwave hydro-treating using hydrogen gas and conventional heating and microwave activation, and the hydro-treating is carried out at high pressure and at a temperature below 220° C.

52. The process of claim 51, wherein the leaching step includes placing anode cells in contact with the solution mixture to oxidize ions including ferrous and vanadium ions before the leach solution is recycled to the leaching step.

53. The process of claim 51, further including a metals recovery step which comprises:

separating a bleed stream from the solution mixture stream after an anode cell, adjusting the pH of the bleed solution to about between 1.5 and 2.5 using calcium or sodium hydroxide or carbonate, applying hydrogen sulfide gas to the solution mixture to precipitate metal sand filtering the precipitate, adjusting the pH of the boiling solution to about between 3.0 to 3.5 using soda ash to precipitate iron oxide and filtering the iron oxide precipitate from the solution, applying an oxidizing agent including hydrogen peroxide to convert vanadium ions to their highest oxidation state before applying soda ash or ammonia to the solution to increase the pH to about 3.6 to 4.6, applying hydrogen sulfide gas to the solution to precipitate vanadium sulfide and filtering the vanadium sulfide precipitate, adjusting the pH of the hot solution to between about 8 and 10 using soda ash or ammonia to precipitate vanadium hydroxide, and subjecting the waste solution to a vacuum to recover any remaining hydrogen sulfide gas.

54. A process to extract and recover heavy metals and sulfur from crude oil or petroleum fuel products comprising:

emulsifying the crude oil with an emulsifying agent;

adding a leach solution containing an inorganic acid to the emulsified crude oil and leaching the emulsified crude oil at an elevated temperature and pressure to provide a leached emulsified crude oil and a leachate;

separating the leached emulsified crude oil and the leachate; removing a proportion of the leachate;

recovering sulfur or heavy metals from the leachate; washing the leached emulsified crude oil with water; and separating the leached emulsified crude oil and the washing water;

wherein the leaching step comprises:

leaching the emulsified crude oil with an acid leach solution, washing the acid leached emulsified crude oil with water, separating the crude oil from the wash water, re-emulsifying the crude oil, leaching the re-emulsified crude oil with an alkali leach solution, washing the alkali leached re-emulsified crude oil with water, and separating the crude oil from the wash water.

55. The process of claim 54, wherein the acid and alkali leached crude oil is subsequently microwave hydro-desulfurized.

56. The process of claim 9, wherein the microwave energy is applied to the leach solution at about 800 to 22,000 megahertz frequency.

57. A system to extract and recover heavy metals and sulfur from crude oil or petroleum fuel products comprising:

a mixer adapted to receive the crude oil or petroleum fuel products and an emulsifying agent to provide an emulsified product;

a leaching device which combines the emulsified product and a leaching solution to form a leached emulsified product and a leachate during the application of microwave energy;

a microwave generator to provide microwave energy to the leaching device;

a first separator, said first separator providing a leached emulsified product stream and a leachate stream; and a recovery system to treat the leachate stream, said recovery system constructed to recover sulfur or heavy metals.

58. The system of claim 57, wherein said first separator comprises two or more stages having liquid-liquid separators disposed between said two or more stages.

59. A system to extract and recover heavy metals and sulfur from crude oil or petroleum fuel products comprising:

a mixer adapted to receive the crude oil or petroleum fuel products and an emulsifying agent to provide an emulsified product;

a leaching device for combining the emulsified product and a leaching solution to form a leached emulsified product and a leachate;

a first separator, said first separator providing at leached emulsified product stream and a leachate stream;

a recovery system to treat the leachate stream, said recovery system constructed to recover sulfur or heavy metals;

a microwave hydro-desulfurization device disposed downstream of the first separator, said microwave hydro-desulfurization device adapted to generate a desulfurized crude oil and a hydrogen sulfide by-product;

a second separator, said second separator providing a desulfurized crude oil stream and a hydrogen sulfide by-product stream; and a sulfur recovery device to recover sulfur from the hydrogen sulfide by-product stream.

60. The system of claim 59, wherein said second separator comprises two or more stages having liquid-liquid separators disposed between said two or more stages.

61. The system of claim 59, further comprising a washing device disposed downstream of said microwave hydro-desulfurization device, and a third separator providing a washed, desulfurized crude oil stream, wherein said third separator comprises one or more stages having liquid-liquid separators disposed between said two or more stages.

62. The system of claim 59, wherein said microwave hydro-desulfurization device further comprises conventional heaters.

63. The system of claim 59, wherein said microwave hydro-desulfurization device is fitted with a hollow shaft for the introduction of gas, and an impeller and baffle assembly to provide intense mixing.

64. The system of claim 59, wherein said microwave hydro-desulfurization device is a vertical cylindrical vessel.

65. The system of claim 59, wherein said microwave hydro-desulfurization device is a multi-compartment horizontal cylindrical vessel.

66. The system of claim 59, wherein said microwave hydro-desulfurization device is fitted with microwave generators and wave guides through quartz windows disposed at the bottom or sides of said microwave hydro-desulfurization device.

67. A system to extract and recover heavy metals and sulfur from crude oil or petroleum fuel products comprising:

a mixer adapted to receive the crude oil or petroleum fuel products and an emulsifying agent to provide an emulsified product;

a leaching device for combining the emulsified product and a leaching solution to form a leached emulsified product and a leachate;

a first separator, said first separator providing a leached emulsified product stream and a leachate stream; and a recovery system to treat the leachate stream, said recovery system constructed to recover sulfur or heavy metals;

wherein said sulfur or heavy metals recovering system further comprises:

a conveyance device in fluid communication with the leaching device and a first mixer said first mixer adapted to permit adjustment of the pH of the leachate to about 1.5 to 2.5 using calcium or sodium hydroxide or carbonate;

a second mixer adapted to introduce hydrogen sulfide gas to the pH-adjusted leached product, said second mixer disposed downstream of said first mixer and constructed to permit removal of precipitated sulfides from a sulfide-lean product stream;

a third mixer disposed downstream of said second mixer, said third mixer adapted to heat and adjust the pH of the sulfide-lean product stream to about between 3.0 and 3.5 and constructed to permit removal of iron as a precipitate;

a vanadium recovery system disposed downstream of said third mixer, said vanadium recovery system adapted to introduce an oxidizing agent and to permit pH-adjustment to increase the pH to about 3.6 to 4.6 to recover precipitated vanadium sulfides and vanadium oxide; and a vacuum device to recover waste gases downstream of said vanadium recovery system.

* * * * *